United States Patent [19]

Knabenhans

[11] Patent Number: 4,890,338

[45] Date of Patent: Jan. 2, 1990

[54] SUPPORTIVE FASTENING MEANS FOR A PROTECTIVE HELMET

[75] Inventor: Balz Knabenhans, Ennetbürgen, Switzerland

[73] Assignee: Drägerwerk Aktiengesellschaft, Lübeck, Fed. Rep. of Germany

[21] Appl. No.: 282,017

[22] Filed: Dec. 8, 1988

[30] Foreign Application Priority Data

Jan. 8, 1988 [CH] Switzerland ..... 00061/88

[51] Int. Cl.[4] ..... A42B 3/00; A42B 7/00

[52] U.S. Cl. ..... 2/421; 2/205

[58] Field of Search ..... 2/410, 4, 6, 417, 421, 2/425, 202, 204, 205

[56] References Cited

U.S. PATENT DOCUMENTS 2,411,994 12/1946 Hoffman ..... 2/204

3,676,879 7/1972 Ine ..... 2/202

FOREIGN PATENT DOCUMENTS 1096070 6/1955 France ..... 2/421

*Primary Examiner*—Werner H. Schroeder

*Attorney, Agent, or Firm*—McGlew & Tuttle

[57] ABSTRACT

A helmet fastening system for protective helmets includes a drawstring system which holds the helmet smoothly to the head of the wearer in the forehead and temple areas and in the neck area simply by tightening only a chin strap. Two drawstring loops are movably arranged in an integrated guiding channel which comprises a leather pocket parallel to and attached to the helmet rim. The length-adjustable chin strap form a closed drawstring system outside the guiding channel. The tightening of the chin strap leads to the spreading of the force between the chin strap, and two chin strap loops of the drawstring system so that the protective helmet and the leather pockets forming the guiding channels fit tightly in the neck and forehead areas of the wearer. A slipping of the protective helment even under the influence of external force is substantially impossible.

10 Claims, 1 Drawing Sheet

SUPPORTIVE FASTENING MEANS FOR A PROTECTIVE HELMET

FIELD AND BACKGROUND OF THE INVENTION

The invention relates in general to protective helmets and to a fastening means for a protective helmet by means of a chin strap which can be adjusted in length and which is connected to the shell of the helmet by a holding or fastening device.

A similar device has been shown, e.g. in the German OS No. 2 156 338, as an essentially conventional chin strap which is attached to strong leather segments arranged at the sides of the helmet with one snap fastener on each side. The chin strap is adjustable in length and serves to secure the helmet on the head of the wearer.

A disadvantage of this known fastening device and method is that the fit of the protective helmet cannot be guaranteed, especially under the influence of external force, and that at least a sliding of the helmet on the head is possible.

SUMMARY OF THE INVENTION

The invention is based on the task of suggesting a helmet-fastener-system for high pulling forces and which is very comfortable, and which seals the helmet well against draft and noise and wherein the helmet also fits the head of the wearer snugly and a good fit is guaranteed. Also external forces which might have an impact on the shell of the helmet are spread evenly over the fasteners in a way which substantially prevents the helmet from slipping on the head of the wearer.

Advantages of the invention include adjustability provided by drawstring loops which are led adjustably through leather pockets in the forehead/temple area and in the neck area of the wearer. The leather pockets are arranged parallel to the helmet rim or helmet edge. The draw strap loops and the chin strap form a closed, endless draw string system which, together with the leather pockets, guarantees a snug fit between the helmet rim and the head of the wearer. Under the impact of external forces, the protective helmet sits always tightly and immovably on the head of the wearer and the forces are spread over the full length of the leather pockets by means of the closed drawstring system. Furthermore, the helmet is sealed well against draft and noise due to the fastening device according to the invention.

Accordingly, it is an object of the invention to provide a fastening device for a protective helmet which includes a helmet shell portion with a rim which encompasses a portion of the wearer's face and extends around the neck of the wearer into a drawstring system for the helmet which includes a channel which is defined adjacent the rim of the helmet and extends around the wearer's face and terminates in openings on each side of the wearer's chin and accommodates a drawstring which forms a first loop which forms an adjustable chin strap and a second loop portion which is connected adjacent the ends of the first loop at locations on each side of the chin and forms a drawstring system with it.

A further object of the invention is to provide a protective helmet which includes material layers formed around a rim of the helmet which are overlapped and form a guide channel therethrough through which a drawstring extends and which has openings at each side of the wearer's chin so that the drawstring guided in the channel has a loop portion which extends below the wearer's chin and may be adjusted to fit the chin and to effect tight engagement of the lining material at the wearer's face.

A further object of the invention is to provide a helmet fastening device which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENTS

Figure 1:
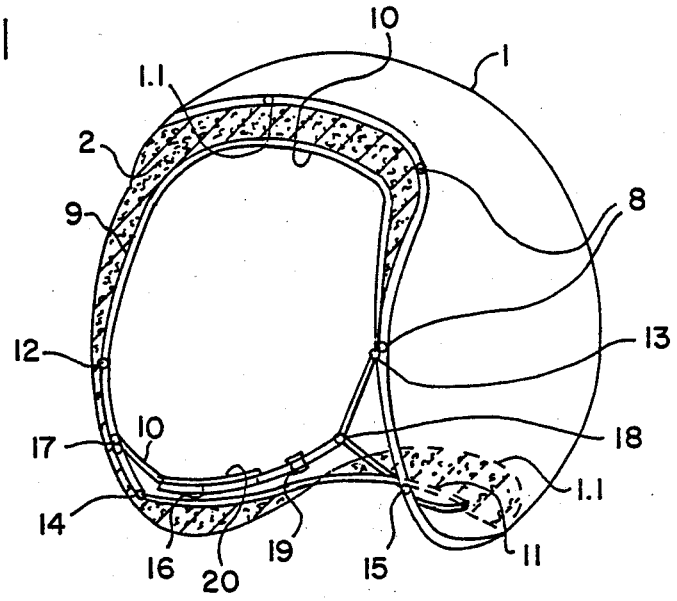
FIG. 1 is a front and side perspective view of a protective helmet with a fastening arrangement constructed in accordance with the invention.

Referring to the drawings in particular, the invention embodied therein comprises a protective helmet construction and a drawstring fastening arrangement for the protective helmet. The protective helmet includes an impact resistant material shell 1 which has a lining of shock absorbing material 21 and it includes a guide channel formation 7 for guiding a drawstring 9 which forms a first drawstring loop 10 which extends around the periphery of the wearer's face and chin with an outside portion 16 forming a chin strap which is adjustable. In addition, a second drawstring loop portion 11 has respective ends which are connected adjacent the ends of the chin strap at connections 17 and 18.

Figure 2:
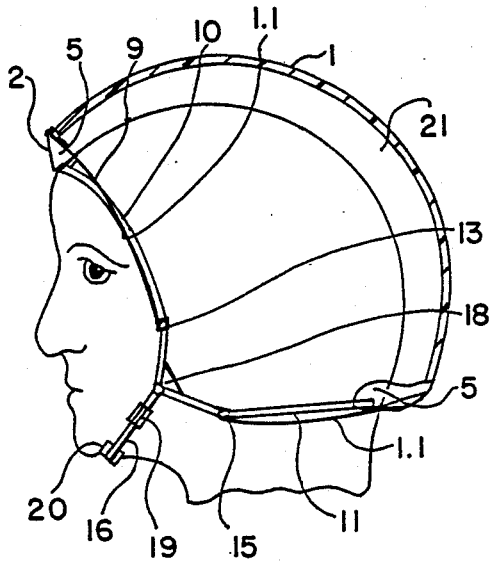
FIG. 2 is a vertical section through the protective helmet according to FIG. 1; and, FIG. 3 is a partial cross sectional view through a guiding tube for a drawstring arranged parallel to the helmet rim.
Figure 3:
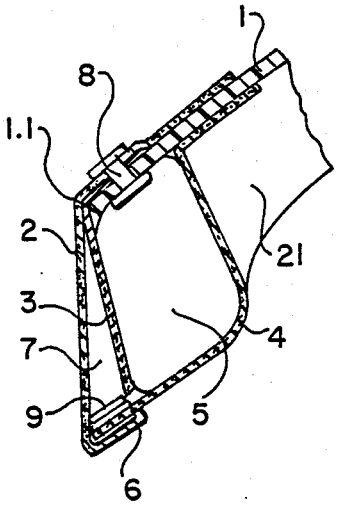

In FIGS. 1, 2 and 3, the outer shell of the helmet has the reference number 1. On the shell 1 of the helmet an outer leather cover 2, a middle leather cover 3 and an inner leather cover 4 containing a padding 5 from foam material. The three leather covers 2, 3 and 4 are connected by a seam 6. In addition, the edges of the leather covers are glued together, and also to the edge of the shell of the helmet 1, and in addition, the outer cover 2 and the middle leather cover 3, form a common integrated guiding channel 7, are riveted to the shell of the helmet 1 with rivets 8 located at least at the stress point. A drawstring 9 forms a first drawstring loop 10 which, together with the outer, middle and inner leather covers 2, 3 and 4 frames the forehead and temples of the wearer and it forms a second drawstring loop which, also with the leather covers 2, 3 and 4 frames the neck of the wearer. The first drawstring loop 10 of the drawstring 9 protrudes from both sides of the shell of the helmet 1 in the cheek area of the wearer from a respective reinforced guiding channel outlet 12 and 13 of the guiding channel 7.

A second drawstring loop 11 of the drawstring 9 outlets in the neck area of the wearer from the two equally reinforced guiding channel outlets 14, 15 of the guiding channel 7. Outside the integrated guiding channel 7 one end each of the drawstring loop 10 is connected to one end each of the second drawstring loop 11. The ends of the connected drawstring loops 10 and 11 are connected to one end each of a chin strap 16, resulting in two connection points 17 and 18 and in a closed, endless drawstring system. The length of the chin strap 16 can be adjusted by means of a known strap buckle 19 and the strap has chin padding 20. An elastic, shock-absorbent inner padding 21 which is adjusted to the shape of the wearer's head is arranged between the outer shell of the helmet and the wearer's head.

The device described above is used as follows: The protective helmet fitted to the shape of the wearer's head is slipped over the head of the wearer and adjusted while the chin strap 16 and therefore the drawstring loops 10 and 11 are loose. Then the chin strap 16 is tightened by means of the strap buckle 19 until the chin padding 20 touches the chin well. Simultaneously the first drawstring loop 10 including a forehead string which is located in the forehead/temple area, and the second drawstring loop or neck string 11 in the neck area, are tightened. Both drawstring loops 10 and 11 which are movable in the guiding channel 7 of the leather pockets attached to the helmet parallel to the helmet rim 1.1 pull the leather pockets to the head and the neck of the wearer by tightening the drawstrings 9. This way a good fit between the helmet rim and the head of the forehead/temples area and the neck area is created. Outlet holes or guiding channel outlets 12, 13, 14 and 15 are reinforced in order to prevent the force components of the drawstrings 7 from creating damages in the area of the guiding channel outlets 12, 13, 14, 15 when the chin strap 16 is tightened. In order to adjust the leather pockets more easily to the head and the neck while the drawstrings are tightened, a leather covered foam padding 5 is arranged between the inner helmet padding 21 and the guiding channel 7 of the drawstring 9. The connecting seam 6 on the inside of the guiding channel 7 stiffens the guiding channel to a certain extent and increases the form stability of the leather cover. At any attempt of pulling the helmet off the head the spreading of the force between the chin strap 16, the first drawstring loop 10 and the second drawstring loop 11 immediately leads to a tightening of the drawstring system and to a tighter fit in the forehead and the neck areas.

The leather covers referred to in the description could of course be replaced by other materials with similar properties.

While specific embodiments of the invention have been shown and described in detail to illustrate the application of the principles of the invention, it will be understood that the invention may be embodied otherwise without departing from such principles.

What is claimed is:

1. A fastening device for a protective helmet comprising a helmet-forming shell with a face encompassing rim portion and a neck encircling rim portion, a length adjustable chin strap connected to said shell, means defining a guide channel around the rim of said helmet, a first drawstring loop arranged in said shell guide channel in the forehead/temple area of the protective helmet, a second drawstring loop in the neck area, both said first and second loops being tensionally rigid being movable in said guiding channel, said first drawstring loop having an exterior portion extending outside of said guiding channel, and a second drawstring loop having ends connected to the outside portion of said first drawstring loop adjacent the respective outside ends of said loop and forming a closed drawstring system therewith, said outside portion of said loop forming said length adjustable chin strap.

2. A fastening device according to claim 1, wherein said means defining a guide channel comprises a leather pocket secured to the helmet rim, said guiding channel having outlets on each side of the wearer's face which are reinforced.

3. A fastening device according to claim 1, wherein said drawstring comprises a woven strap made from tensionally rigid artificial fibers.

4. A fastening device according to claim 1, including a soft padding arranged on the inside of said helmet shell, said guiding channel being formed by an inner helmet padding covering said guide channel which includes an interior loop portion encompassing said padding.

5. A fastening device according to claim 1, wherein said guiding channel is formed by a leather pocket, said pocket having at least one seam made with overlapping leather pieces.

6. A fastening device according to claim 1, including a coupling element connected between said first and second loops.

7. A fastening device for a protective helmet having a wearer's face embracing rim adapted to be arranged around a portion of the wearer's face, comprising means on the helmet defining a guiding channel around the rim terminating in openings on each side of the wearer's face, a drawstring engaged in said guiding channel and having a first drawstring loop forming a chin strap adapted to be engaged below the wearer's chin, means for adjusting the length of said first drawstring loop, and a second drawstring loop having respective end portions connected to said first drawstring adjacent each end thereof and forming a drawstring system therewith.

8. A protective helmet for personnel comprising an outer shell of shock-resistant material having a rim encircling at least the upper portion of the wearer's face and extending around at least a portion of the wearer's neck, first and second overlapped layers of material lining said helmet around a portion of the rim extending around the wearer's face and defining a guide channel therebetween having a guide opening on each side of said rim adjacent the wearer's chin, and a drawstring in said guide channel forming at least one chin strap loop below the chin of the wearer and, means for adjusting the length of said chin strap loop.

9. A protective helmet according to claim 8 including a second chin strap portion forming a second loop having respective ends connected to said chin strap loop adjacent each of the ends thereof which are exterior of said helmet.

10. A protective helmet according to claim 9, wherein said first and second overlapped layers of material includes an inner layer forming the interior wall of said channel and which has an inwardly extending loop portion, and padding in said inwardly extending loop portion including a rivet connected to said helmet and joining said inner and outer layers together.

* * * * *